US006035908A

United States Patent [19]

Hoffmann

[11] Patent Number: 6,035,908

[45] Date of Patent: Mar. 14, 2000

[54] WIDE MOUTH FUNNEL

[76] Inventor: Ross W. Hoffmann, 6701 Shelburn Dr., Crestwood, Ky. 40014

[21] Appl. No.: 09/198,671

[22] Filed: Nov. 23, 1998

[51] Int. Cl.[7] ..... B65B 1/04

[52] U.S. Cl. ..... 141/331; 141/340; 141/316

[58] Field of Search ..... 141/331–345, 141/316

[56] References Cited

U.S. PATENT DOCUMENTS

| | | | |
|---|---|---|---|
| D. 29,377 | 9/1898 | Brubaker . | |
| D. 121,781 | 3/1940 | Walcott . | |
| D. 185,115 | 5/1959 | Beerman . | |
| 343,871 | 6/1886 | Van Kammen | 141/331 |
| D. 360,510 | 7/1995 | Slovak . | |
| 1,088,633 | 2/1914 | Simmons et al. . | |
| 1,134,837 | 4/1915 | Fox | 141/331 |
| 1,211,278 | 1/1917 | Blum . | |
| 1,595,660 | 8/1926 | Huntley . | |
| 1,612,383 | 12/1926 | Lepeshkin . | |
| 1,791,826 | 2/1931 | Middleton | 141/340 |
| 3,915,329 | 10/1975 | Zaks . | |
| 4,069,996 | 1/1978 | Koziol . | |
| 4,191,226 | 3/1980 | Kyte . | |
| 4,698,861 | 10/1987 | Bogusz . | |
| 5,121,779 | 6/1992 | Green . | |
| 5,226,554 | 7/1993 | Dauphinais . | |
| 5,538,050 | 7/1996 | Galdon . | |
| 5,597,022 | 1/1997 | Reifers . | |

*Primary Examiner*—Steven O. Douglas
*Attorney, Agent, or Firm*—Middleton & Reutlinger; John F. Salazar

[57] ABSTRACT

The present apparatus relates to a funnel which is used to transfer food or liquid into receptacles, such as reclosable freezer or storage bags. The funnel is comprised of an ovalized wide mouth opening and a long neck with a plurality of legs which are rounded at the end and extend downwardly from the bottom portion of the neck. Once placed inside the bag, the neck of the funnel serves as a supporting device for interior wall of the storage bag and prevents the bag from collapsing upon filling. The plurality of legs provides for slotted openings at the base of the funnel which allow for quick disbursement of the food or liquid and prevents clogging of the funnel or backflow of the funnel chamber during the transfer of foods or liquids. Although the funnel is designed to fit within a quart size storage bag, an adaptable base which can be screwed on and off the base if the funnel can be used to accommodate different size bags or receptacles. Additionally, the ovalized wide mouth opening of the funnel is also capable of receiving a strainer for the separation of liquids from solids.

8 Claims, 4 Drawing Sheets

WIDE MOUTH FUNNEL

BACKGROUND OF THE INVENTION

1. Field of the Invention

The present invention relates to funnels and more particularly to funnels which can be utilized to transfer food or liquid into receptacles such as a reclosable storage style bags and which allow for quick disbursement of the food from the funnel into the receptacle.

2. Discussion of the Prior Art

The use of funnels for the transferring of food or liquid, especially, when working in the kitchen, is well known. Most funnels have many disadvantages which limit their use significantly. For example, most funnels are not capable of being used to transfer food or liquid into a receptacle such as a reclosable storage bag. When attempting to transfer food or liquid into a reclosable bag, the traditional funnel provides no assistance since one hand is needed to hold the reclosable storage bag open and the other hand is needed to support the funnel, leaving no free hand to transfer the food or liquid.

Another disadvantage of traditional funnels is that they typically have a narrow opening at the end of the funnel chamber which does not allow for rapid transfer of the food or liquid into the receptacle receiving the substance. This limitation is often responsible for clogging of the opening and/or a backflow of the substance from the funnel chamber during the transfer process.

SUMMARY OF THE INVENTION

The present invention is a funnel used for filling various receptacles, including reclosable freezer or storage bags. The funnel is comprised of an ovalized wide mouth opening having a long neck and a plurality of legs with rounded ends extending downward from the lower portion of the neck.

One object of the invention is to provide a funnel which can be easily used with reclosable freezer or storage bags and prevents these bags from collapsing while filling the bag with food or liquid. Another object of the invention is to provide a funnel which allows for quick disbursement of food or liquid during the transfer of food or liquids and thereby prevents the clogging of the funnel chamber and thus reduces the chances of a backflow in the funnel chamber during the transfer.

Yet another object of the present invention is to provide a means for measurement of the amount of food or liquid being transferred through the funnel. It is a further object of the invention to provide for a funnel which is capable of receiving a strainer at the opening of the funnel in order to allow for separation of liquids from other foods. Finally, another object of the present invention it to provide a funnel which can accept a removable base, to allow the funnel to be adaptable to different size of reclosable freezer or storage bags.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

Figure 1:
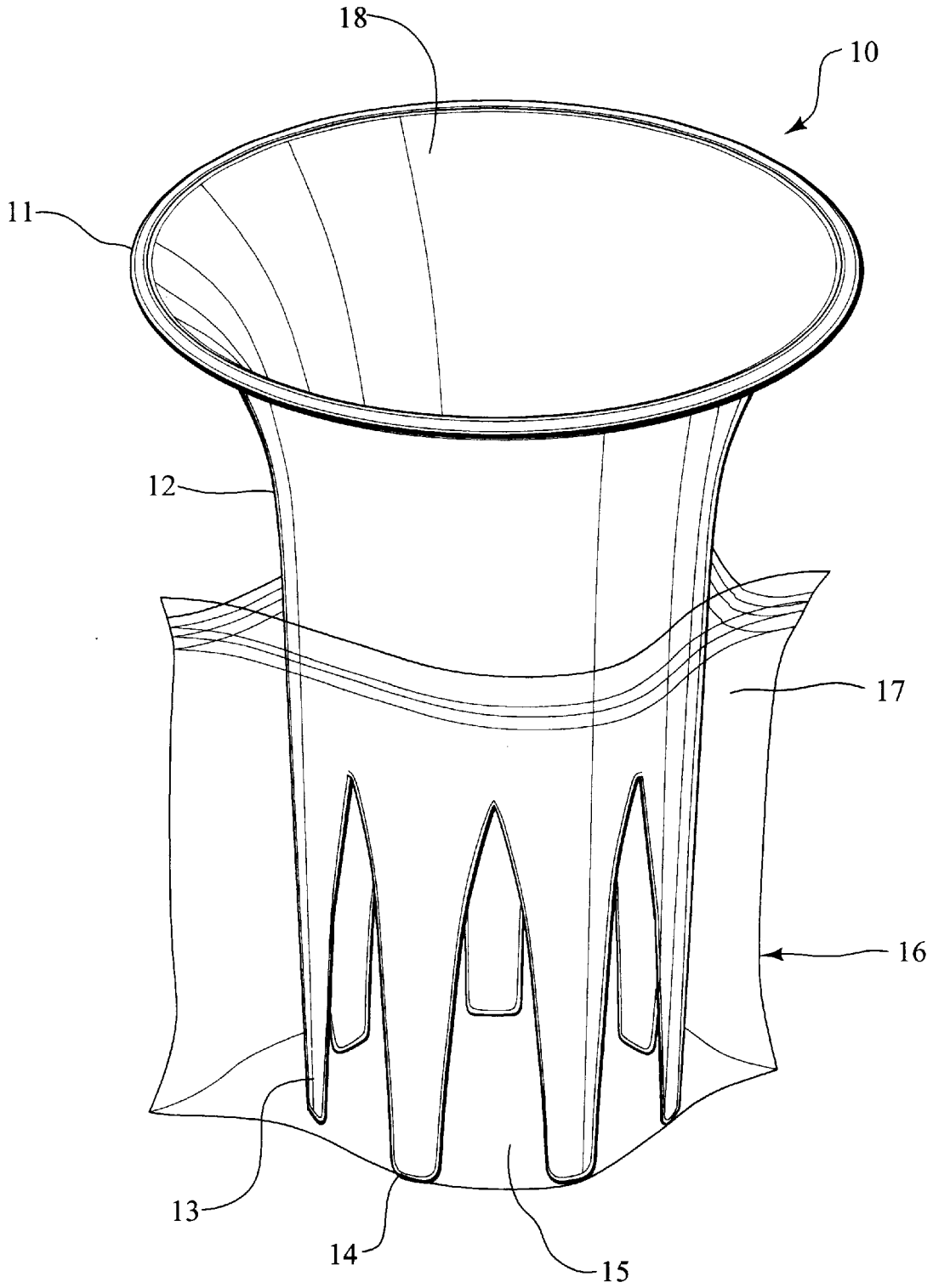
FIG. 1 is a perspective view of the wide mouth funnel of the present invention engaged with a reclosable storage bag.

Referring to FIG. 1, there is illustrated generally in perspective view a wide mouth funnel 10 engaged in a reclosable storage bag 16. The funnel 10 is designed for easy insertion of food like material into a storage bag or the like receptacle 16. To this end, a funnel 10 is provided with an oversized mouth 11, a long upstanding neck 12 and a plurality of legs 13 which allow the funnel to stand up on its own. The ability of the funnel to be in a self-supporting upright position due to the long legs 13 and long neck 12 is of significant import in that the funnel allows the storage bag 16 to remain open and the funnel to distribute the food-like material therein without the requirement of having the user hold the bag or funnel while pouring food into the funnel/bag combination.

For easy distribution of food or other material into the storage back, the oversized mouth 11 is provided and may be between about 8.5 inches and about 6.6 inches wide. The funnel 10 is comprised of an ovalized wide mouth opening 11 and a long neck 12 with a plurality of legs 13 depending therefrom. The mouth opening 11 of the funnel 10, as shown in FIG. 1, is flared outwardly to provide an easy opening for entry of food and the like material into the funnel to be transferred into the bag 16.

The legs underneath the oversized mouth 11 of the funnel have rounded ends 14 which allow for easy insertion into receptacles such as a reclosable storage bags, without puncturing, ripping or causing damage to the bag. Further, the legs are separated from each other by approximately 1⅛ inch in order to provide significant flow of the inserted material through the legs 13 and into the storage receptacle 16. This is especially important when the material being placed in the storage bag 16 is not very viscous. Without the spaces between the legs 13, material would back up into the neck 12 of the funnel 10 thereby limiting the amount of material the user could place into the funnel at any given time, possibly well before the storage bag 16 is completely full. As shown in the drawings, the individual legs 13 are connected to the bottom portion of the neck and extend downward therefrom. The plurality legs 13 taper inwardly in width from a maximum width of about 4 inches circumference at the point directly below said neck 12 to a minimum of about 3.5 inch circumference at the opposite distal end 14 where the edges are rounded.

The neck 12 of the wide mouth funnel 10 is designed to fit against the interior walls 17 of the storage bag 16 and acts to support the storage bag 16 and thus prevents the bag 16 from collapsing while it is being filled with food or liquid. As can be seen from the figures, the bag may be kept in its full upright position due to the design of the funnel 10 in order to increase the filling capacity of the storage bag 16 without any intervention from the user.

Figure 2:
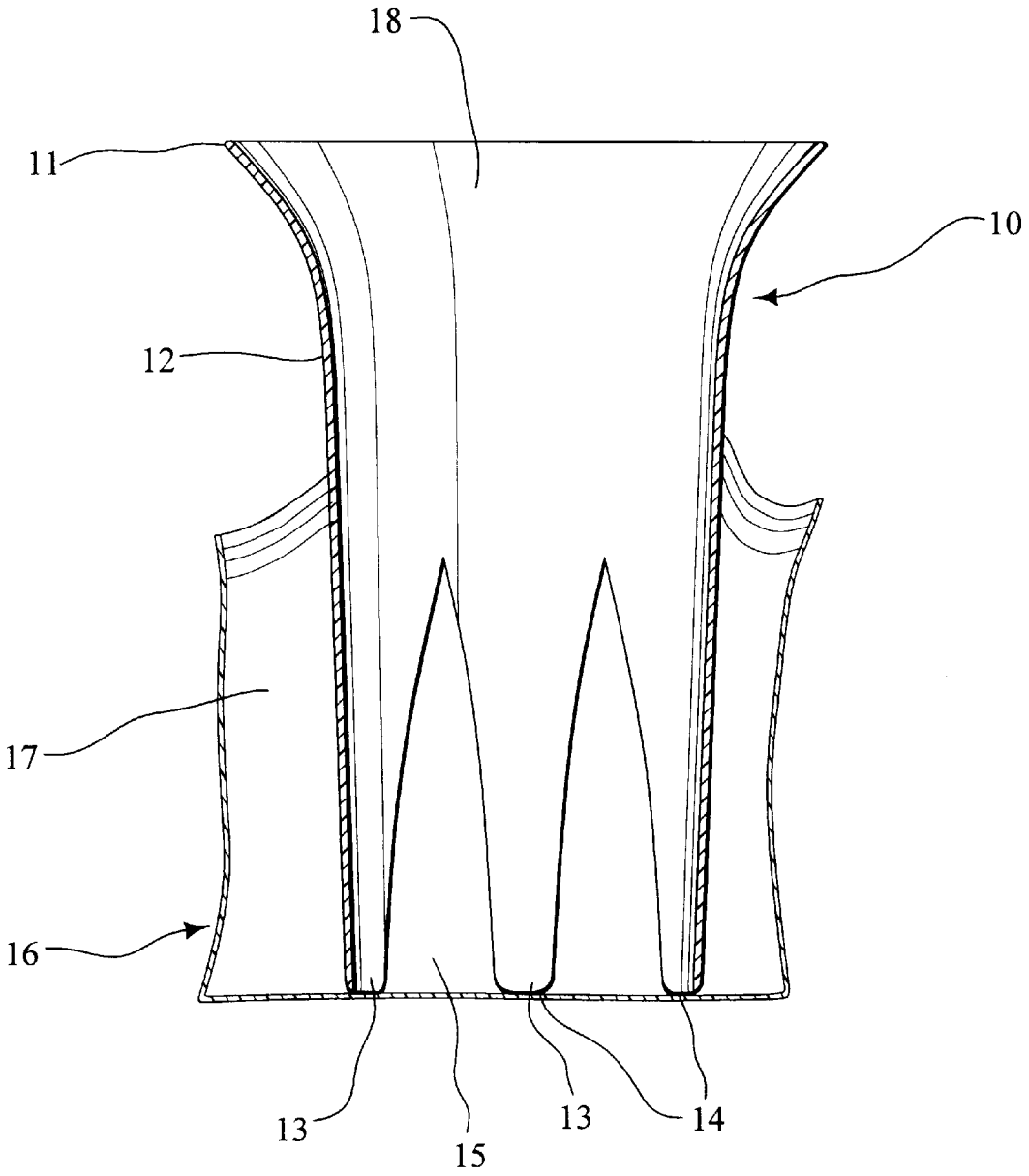
FIGS. 2 and 4 are side views of the wide mouth funnel of the present invention engaged with a storage bag; and, FIG. 3 is a side view of the wide mouth funnel of the present invention adapted to receive a strainer used for separating liquid from other foods in the opening of said funnel and engaged with a reclosable storage bag.

The sharp vertical drop in the angle of the funnel chamber 18 allows for food and liquid to settle quickly in the bottom of the receptacle. As can be best seen in FIG. 2, the funnel tapers slightly from the lip or mouth area 11 into the funnel chamber 18 where it begins a fairly steep drop into the neck 12 of the funnel. As seen more clearly in the side view of FIG. 2, the junction area between the mouth 11 and the neck 12 is substantially smooth and lacks any sharp angles typically found in funnels. This smooth transition area or curve between the mouth and the neck allows the mouth to be significantly wider than most funnels while the neck and remainder of the funnel is substantially vertical. The tapering from the lip or mouth 11 to a nearly vertical neck 12 occurs over a very short area allowing for a wide mouth 11 for entry of food material or the like and ensures that the material falls directly into the storage bag 16.

Additionally, as previously mentioned, the downwardly extending legs 13 provide for slotted openings 15 so as to allow for quick disbursement of food or liquid, thereby preventing clogging of the funnel chamber 18 and decreases the chances of backflow occurring.

The legs 13 of the wide mouth funnel 10 may be color-coded for the measurement of liquid up to one quart, and thereby prevents the overfilling of the quart size storage bags.

Figure 3:
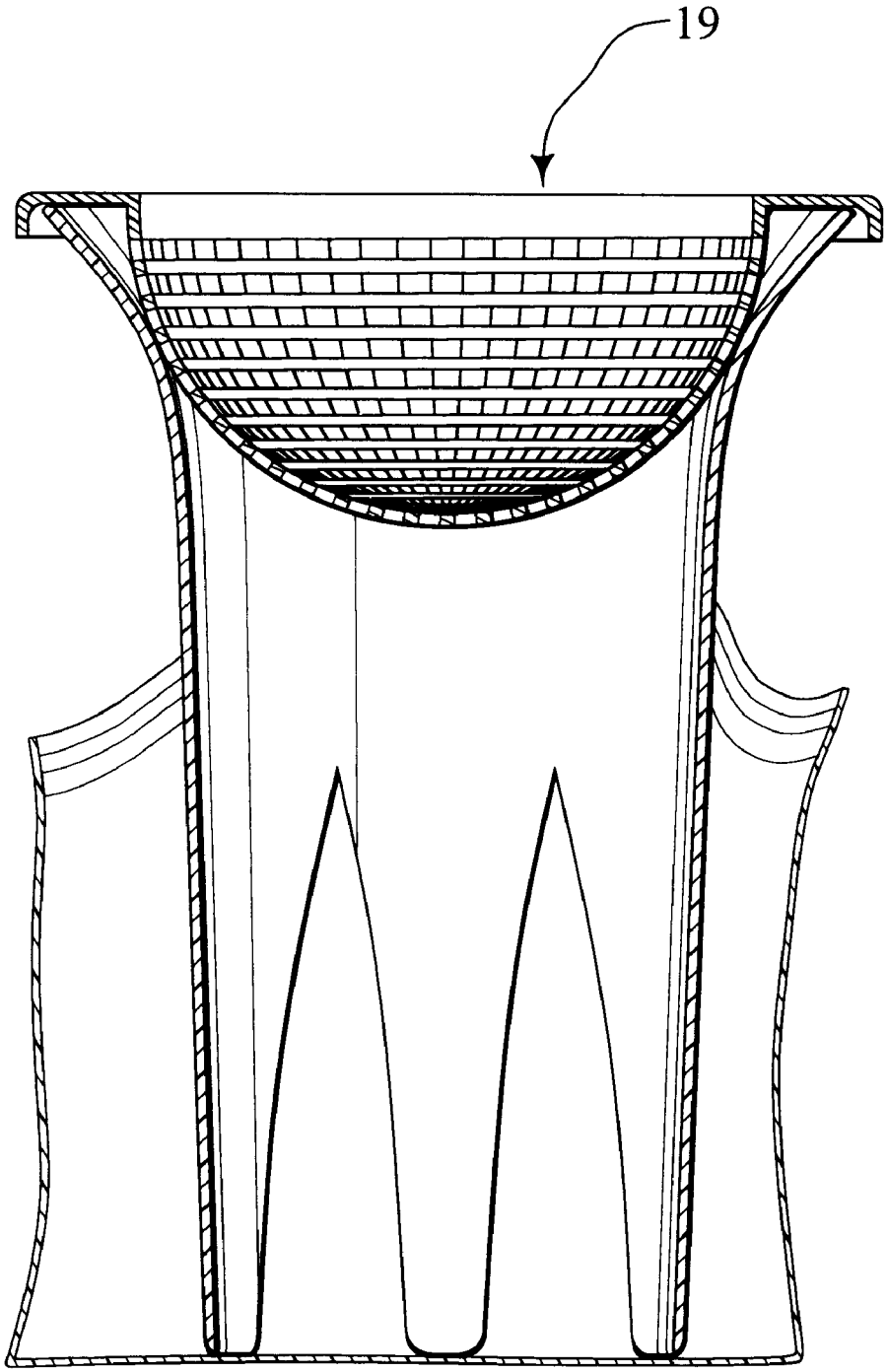

FIG. 3 which illustrates how a strainer 19 could be adapted to be received by the ovalized wide mouth opening 11 of the wide mouth funnel 10. The strainer 19 is used for separating liquid from other foods.

Figure 4:
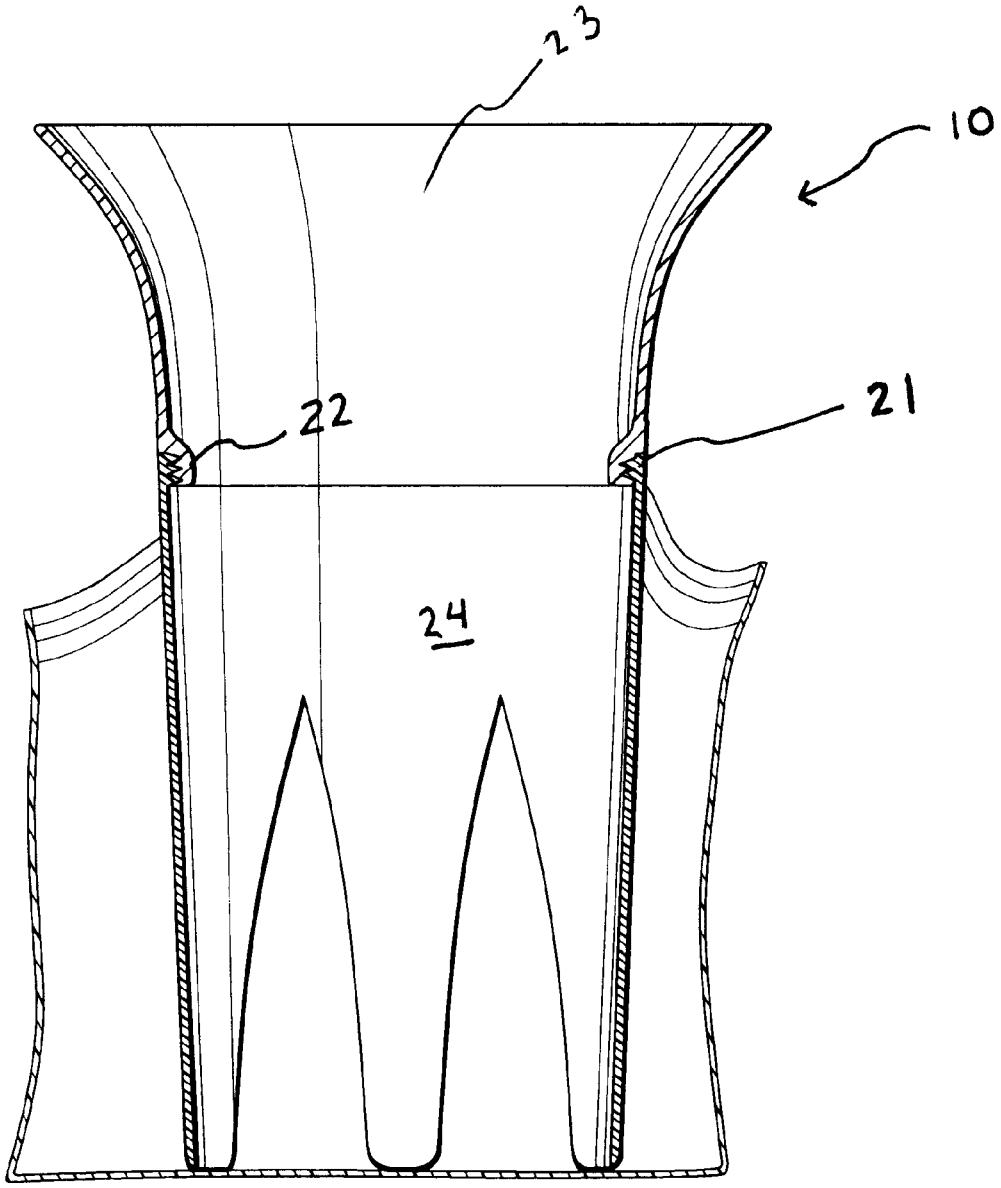

The wide mouth funnel 10 can be designed to be adaptable to different size bags by creating a removable base, which is screwed on and off. As shown in FIG. 4, an alternative embodiment is provided for wherein the upper portion 23 is separable from the lower portion 24 of the funnel thereby allowing them to be separated. The upper portion 23 has outwardly extending thread section 22 which engages inwardly directed thread section 21 of the lower portion 24. By including the ability to interchange different length lower sections 24 with the upper portion 23, the funnel may then be adapted to smaller funnel height and tapered neck size. Therefore, different volume/size bags may be used simply by interchanging the funnel with a shorter lower section 24.

The funnel 10 may be made of a durable rigid plastic material, such as Polypropylene, PE, PET, HDPE or other plastic, or may even be made of a lightweight metal such as aluminum.

The foregoing detailed description is given primarily for clearness of understanding and no unnecessary limitation are to be understood therefrom for modifications will become obvious to those skilled in the art upon reading this disclosure and may be made without departing from the spirit of the invention or the scope of the appended claims.

What is claimed is:

1. A wide mouth upstanding funnel comprising:

an oversized ovalized mouth extending outward to a rim, said rim having a diameter equal to said mouth;

a smooth convex curvilinear portion extending downwardly and inwardly from said rim to a widened neck portion, said widened neck portion extending downward to a base portion, said base portion having a plurality of legs;

wherein said purality of legs are separated by slotted openings, each of said slotted openings being wider than each of said legs;

and further wherein each of said legs of said base portion are of sufficient diameter to stand said funnel upright.

2. The funnel of claim 1 further comprising a bowl-shaped strainer, said strainer fitting within said ovalized mouth portion and removabley engageable with said rim.

3. The funnel of claim 1 wherein said neck portion is divided into an upper portion and a lower portion, said upper portion threadably engageable with said lower potion and removable therefrom.

4. The funnel of claim 1 wherein said legs taper in width from a maximum directly below said neck portion to a minimum at the opposite distal end of each of said plurality of legs.

5. The funnel of claim 4 wherein each of said legs has rounded ends at opposite distal end.

6. A funnel having an oversized mouth comprising:

an ovalized mouth having a rim portion, said rim portion having a diameter equal to said mouth;

a funnel chamber, said funnel chamber extending from said rim portion to a neck portion, said funnel chamber having a smooth convex curveliniar surface between said rim portion and said neck portion;

a base portion extending below said neck portion, said base portion having a plurality of legs extending circumfrentialy below said neck portion;

a plurality of slotted openings between each of said plurality of legs, each of said slotted openings being wider than each of said plurality of legs;

and further wherein said neck portion is divided into an upper portion and a lower portion, said upper portion threadably engagable to said lower portion and removable therefrom.

7. The funnel of claim 6 wherein each of said legs has rounded ends at their lower most distal end.

8. A wide mouth upstanding funnel comprising:

an oversized ovalized mouth extending outward to a rim, said rim having a diameter equal to said mouth;

a smooth convex curvilinear portion extending downwardly and inwardly from said rim to a widened neck portion, said widened neck portion extending downward to a base portion, said base portion having a plurality of legs;

wherein said purality of legs are separated by slotted openings, each of said slotted openings being wider than each of said legs;

means for standing said funnel upright, said means for standing comprising said legs of said base portion being sufficient diameter to support said funnel upright.

* * * * *

UNITED STATES PATENT AND TRADEMARK OFFICE

CERTIFICATE OF CORRECTION

PATENT NO. : 6,035,908
DATED : March 14, 2000
INVENTOR(S) : Hoffmann

It is certified that error appears in the above-identified patent and that said Letters Patent is hereby corrected as shown below:

Claim 6, col. 4, line 29, change "cumfrentialy" to --circumferentially--.

Signed and Sealed this

Twenty-seventh Day of March, 2001

Nicholas P. Godici

*Attest:*

NICHOLAS P. GODICI

*Acting Director of the United States Patent and Trademark Office*

*Attesting Officer*